US006394792B1

(12) United States Patent
McDonald et al.

(10) Patent No.: US 6,394,792 B1
(45) Date of Patent: May 28, 2002

(54) LOW $NO_X$ BURNER APPARATUS

(75) Inventors: John McDonald, Broken Arrow; Tim Kirk, Morris; David J. Surbey, Bixby; Darton J. Zink, Tulsa, all of OK (US)

(73) Assignee: Zeeco, Inc., Tulsa, OK (US)

( * ) Notice: Subject to any disclaimer, the term of this patent is extended or adjusted under 35 U.S.C. 154(b) by 0 days.

(21) Appl. No.: 09/523,261

(22) Filed: Mar. 10, 2000

Related U.S. Application Data

(60) Provisional application No. 60/124,033, filed on Mar. 11, 1999.

(51) Int. Cl.[7] ..... F23D 14/22

(52) U.S. Cl. ..... 431/181; 431/285; 239/424.5; 239/427.3

(58) Field of Search ..... 431/354, 349, 431/181, 115, 285; 239/426, 427.3, 431, 433, 434, 424.5

(56) References Cited

U.S. PATENT DOCUMENTS

| | | | | | |
|---|---|---|---|---|---|
| 2,851,093 | A | * | 9/1958 | Zink, Jr. et al. | 431/285 |
| 3,033,273 | A | * | 5/1962 | Zink, Jr. et al. | 431/181 |
| 3,180,395 | A | * | 4/1965 | Reed | 431/285 |
| 3,217,779 | A | * | 11/1965 | Reed et al. | 431/285 |
| 3,771,944 | A | | 11/1973 | Hovis et al. | 431/284 |
| 3,876,362 | A | | 4/1975 | Hirose | 431/9 |
| 3,915,621 | A | | 10/1975 | Iverson | 431/189 |
| 3,924,574 | A | | 12/1975 | Ebeling | 122/23 |
| 3,954,382 | A | | 5/1976 | Hirose | 431/9 |
| 4,009,989 | A | | 3/1977 | Bitterlich | 431/178 |
| 4,231,735 | A | | 11/1980 | Downs | 431/328 |
| 4,451,230 | A | | 5/1984 | Bocci et al. | 431/284 |
| 4,496,306 | A | | 1/1985 | Okigami et al. | 431/8 |
| 4,505,666 | A | | 3/1985 | Martin et al. | |
| 4,702,691 | A | | 10/1987 | Ogden | |
| 5,073,105 | A | | 12/1991 | Martin et al. | 431/116 |
| 5,098,282 | A | | 3/1992 | Schwartz et al. | 431/9 |
| 5,118,284 | A | | 6/1992 | Mutchler | 431/10 |
| 5,154,596 | A | | 10/1992 | Schwartz et al. | 431/9 |
| 5,238,395 | A | | 8/1993 | Schwartz et al. | 431/10 |
| 5,269,678 | A | | 12/1993 | Schwartz et al. | 431/9 |
| 5,271,729 | A | | 12/1993 | Gensler et al. | 431/175 |
| 5,344,307 | A | | 9/1994 | Schwartz et al. | 431/9 |
| 5,458,481 | A | | 10/1995 | Surbey et al. | 431/115 |
| 5,542,840 | A | * | 8/1996 | Surbey et al. | 431/116 |
| 5,545,031 | A | | 8/1996 | Joshi et al. | 431/8 |
| 5,554,022 | A | | 9/1996 | Nabors, Jr. et al. | 431/10 |
| 5,575,637 | A | | 11/1996 | Slavejkov et al. | 431/8 |
| 5,611,682 | A | | 3/1997 | Slavejkov et al. | 431/8 |
| 5,709,541 | A | * | 1/1998 | Gensler et al. | 431/115 |

* cited by examiner

*Primary Examiner*—Sara Clarke
(74) *Attorney, Agent, or Firm*—Fellers, Snider, Blankenship, Bailey & Tippens, P.C.

(57) ABSTRACT

An improved burner for combustion of fuel gas with air in a manner to result in low $NO_x$, the burner is generally circular and has a refractory tile and gas tips. The gas tips are spaced around the outer circumference of a generally circular passageway in the burner tile, each gas tip is positioned to cause the fuel gas to entrain furnace flue gas. Each gas tip has one or more ports, an ignition port and at least one firing port. The ignition port injects fuel through a passageway to the burner tile. The firing port injects fuel gas in the direction that is generally upward with respect to the pathway of the ignition port. This causes fuel gas to entrain combustion products from the flue gas, the resulting mixture of fuel gas and flue gas is directed out of the burner tile to mix with combustion air that is discharged through the burner tile.

21 Claims, 4 Drawing Sheets

LOW $NO_X$ BURNER APPARATUS

REFERENCE TO COPENDING APPLICATIONS

This application is related to copending Provisional Patent Application 60/124,033, filed on Mar. 11, 1999 and entitled "ROUND FLAME".

REFERENCE TO MICROFICHE APPENDIX

This application is not referenced in any microfiche appendix.

BACKGROUND OF THE INVENTION

1. Field of the Invention

This invention relates to a low $NO_X$ burner for combustion of air and fuel gas.

2. Description of the Related Art

Fuel gas is burned by mixing it with air in the combustion process. Oxygen from the air is combined with the fuel gas that contains combustible components. If the gas is thoroughly mixed with the air and combustion occurs under ideal conditions, the results of the combustion will consist primarily of carbon dioxide, water vapor and nitrogen. Carbon dioxide, water vapor, or nitrogen are not generally harmful to the environment. When a gas burns in a high temperature environment, portions of the nitrogen and oxygen in the atmosphere react to produce oxides of nitrogen ($NO_X$). As a general principle, $NO_X$ production increases as combustion temperature increases. Oxides of nitrogen are generally considered environmental hazards in the atmosphere.

Methods and apparatus to suppress the formation of $NO_X$ have been developed and used heretofore. A common apparatus for reducing the formation of $NO_X$ is a staged air burner apparatus. In a staged air burner apparatus a first portion of combustion air is introduced into a first zone to produce a reducing environment that suppresses $NO_X$ formation and the remaining portion of air is introduced into a second zone. Methods and apparatus have also been developed wherein all the combustion air and some of the fuel is introduced in a first zone with the remaining fuel being introduced into a second zone in a staged fuel approach. An excess of air in the first zone acts as a diluent which lowers the temperature of the burning gases and thereby reduces the formation of $NO_X$. Other methods and apparatus have been developed wherein flue gases are combined with the fuel/air mixtures to dilute the mixtures and thereby lower the combustion temperatures and formation of $NO_X$.

While the prior methods and burner apparatus for producing flue gases having low $NO_X$ contents have achieved varying degrees of success, there still remains a need for improvement in such methods and burner apparatus whereby low $NO_X$ content flue gases are produced by a simple, economical burner apparatus.

BRIEF SUMMARY OF THE INVENTION

The present invention is an improved burner for combustion of fuel gas with air in a manner to result in low $NO_X$ formation. The burner is generally circular and has a refractory tile and gas tips. The burner apparatus bums fuel gas and furnace gases mixed with air to form low $NO_X$ content in a furnace flue gas.

Because of the position of the gas tip within the burner tile, all the fuel gas is mixed with the furnace flue gas. The fuel gas tips are spaced around the outer circumference of a generally circular passageway in the burner tile. Each gas tip is positioned to cause the fuel gas to entrain furnace flue gas. Each tip may be set within the burner tile opening or set back from the opening. The spacing of the gas tips about the circumference of the opening may be symmetrical or asymmetrical. Gas tip elevation may be above, below or flush with the burner tile.

The burner tile has a top and protrusions rising from the top. The protrusions are spaced apart to form a channel along the burner tile top. Each fuel gas tip has multiple ports, at least an ignition port and a firing port. The ignition port injects fuel gas through the passageway made by the protrusions rising from the top of the burner tile. This produces combustion within an ignition zone located on top of the tile.

The firing port injects fuel gas in a direction that is generally upward, with respect to the pathway of ignition port. This causes the fuel gas to penetrate and entrain combustion products from the flue gas. The resulting mixture of fuel gas and flue gas is directed out of the burner tile to mix with combustion air that is discharged through the burner tile.

In the present invention, liquid fuel or a mixture of gas and liquid fuel may be used as well as gas fuel. The discharge of the fuel from either port may be synchronous or asynchronous with respect to other ports or gas tips.

The use of a single gas tip and fuel gas supply pipe for a firing and ignition port, rather than having separate gas tips and piping, is a more economical design.

The arrangement of the firing ports helps to entrain a mixture of air and combustion products from the ignition zone, to provide a cooler temperature burning in the combustion zone.

Other objects and further scope of the applicability of the present invention will become apparent from the detailed description to follow, taken in conjunction with the accompanying drawings wherein like parts are designated by like reference numerals.

DETAILED DESCRIPTION OF THE PREFERRED EMBODIMENTS

Figure 1:
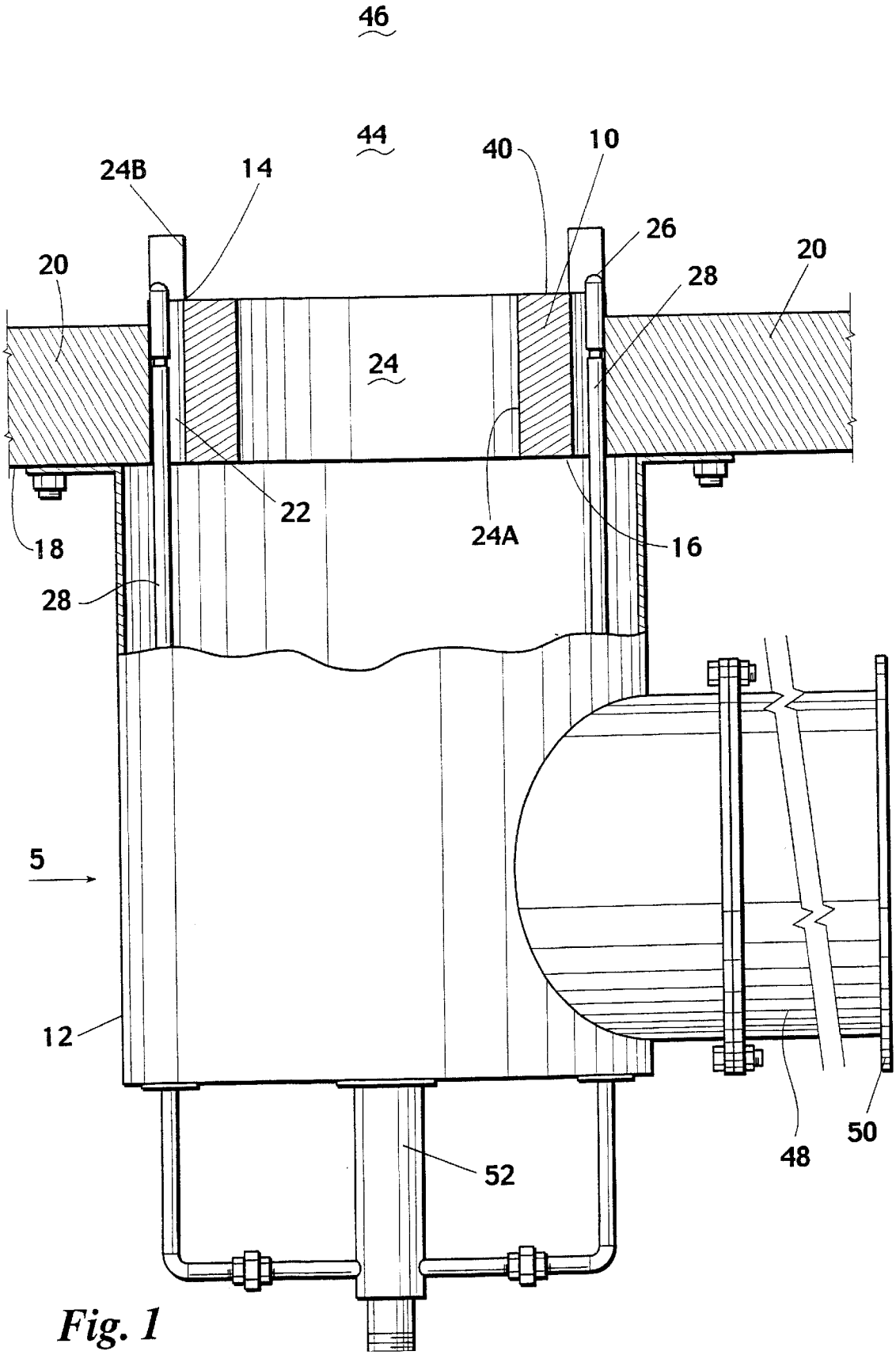
FIG. 1 is a partial, cut-away, front elevation view of a burner apparatus of the present invention.

Before discussing the improved burner for combusting fuel gas in a low temperature/modified air environment with low $NO_X$ production which is the subject of this disclosure, some background information will be helpful to enable the reader to fully understand the important concepts of the burner.

The flue gas $NO_X$ concentration increases as $O_2$ concentration increases at a fixed combustion temperature and as combustion temperature increases at a fixed $O_2$ concentration. Further, as both combustion temperature and $O_2$ concentration decrease in value, so does the flue gas $NO_X$ concentrations at a fixed $O_2$ concentration and combustion temperature respectively.

It must be noted that $NO_X$ values never achieve an equilibrium value in a very short time duration combustion process. For example, the combustion of methane with 15% excess combustion air produces a theoretical adiabatic flame temperature of approximately 3,350° F. resulting in a flue gas oxygen concentration of approximately 2.5% on a wet basis. Using these parameter values, the flue gas $NO_X$ concentration meets 1,000 ppmv.

Actual flue gas $NO_X$ concentrations are much less than 1,000 ppmv because an equilibrium concentration is never achieved. The kinetics for the $N_2+O_2 \rightarrow NO_X$ chemical reaction is slow relative to that required for equilibrium. However, it should be noted that as the temperature of the combustion process increases, the difference between equilibrium and actual flue gas $NO_X$ concentration decreases.

A 15% excess combustion air rate or thereabouts is close to the minimum value required for efficient burning of the fuel gas. This threshold value will insure that the hydrogen ($H_2$) in the fuel gas will convert to $H_2O$ and the carbon (C) to $CO_2$ which means that the concentration of unburned hydrocarbon (UHC) and carbon monoxide (CO) in the flue gas will be environmentally safe.

Combustion of fuel gas should occur at the lowest possible temperature to reduce $NO_X$ production. Use of a cooling means, such as steam, water or recycled gas, can be employed to lower the combustion temperature. However, both water and steam decrease the amount of heat available for heat recovery.

With this background which illustrates the major parameters that affect the production of $NO_X$ during gas combustion, reference will now be made to FIGS. 1 through 5 that illustrate the improved burner of this disclosure.

Referring now to the figures, a preferred embodiment of the burner apparatus of the present invention is illustrated and generally designated by the numeral 5. Burner 5 is preferably formed of ceramic material, that is, a material that will stand high temperatures without deterioration. Burner 5 includes a burner block 10 having an outlet end 14 and an inlet end 16. Outlet end 14 is in communication with the interior of an enclosure in which combustion takes place. In the embodiment shown in FIG. 1, the enclosure is shown with a wall 18 that may be formed of metal. Insulating material 20 is secured to the interior of wall 18. In the illustrated arrangement, insulating material 20 is of a thickness equal to that of bumer block 10. While the equal thickness of insulating material and burner block 10 may be considered the preferred arrangement, it does not mean that the burner must be employed in an environment in which insulating material is equal to the thickness of the block as the block could project into the interior of the enclosure wherein combustion occurs. For protection from thermal compression, a compression layer may be employed between burner block 10 and the insulating material 20 of the enclosure.

Formed in the burner block 10 are a plurality of gas pipe conduits 22. In the embodiments illustrated there are 6 such conduits although the number can vary according to the diameter of the block. These conduits are spaced from and parallel to a central opening 24 formed in the block. Central opening 24 is preferably formed of two parts as illustrated. That is, a first cylindrical portion 24A that communicates with block inlet 16 and a second portion 24B that communicates with block outlet 14.

Figure 5:
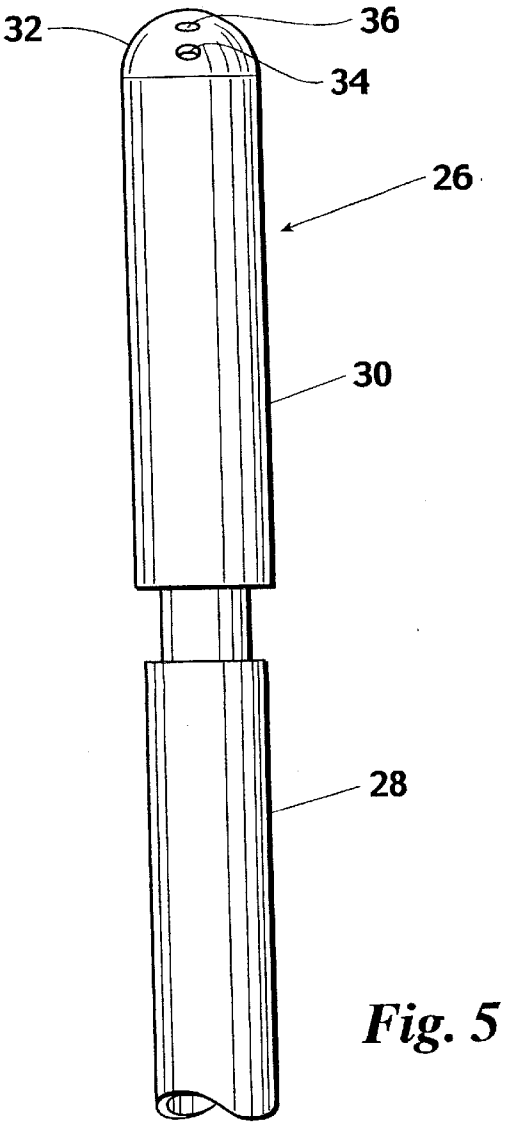
FIG. 5 is a side elevation view of a fuel gas jet tip of the present invention.

Positioned within each gas pipe conduit 22 is a fuel gas jet tip 26 connected to a gas pipe 28. The purpose of each gas tip conduit 22 is to provide access for a gas pipe 28 along with fuel gas jet tip 26. It is not intended to be an access way for flue gas, fuel gas or combustion air. As shown in FIG. 5, fuel gas tip 26 has a fuel gas jet tip body 30 and a fuel gas jet tip head 32. Each fuel gas tip head 32 has an ignition port 34 and may have one or multiple firing ports 36 and are positioned along a substantially common plane.

Figure 2:
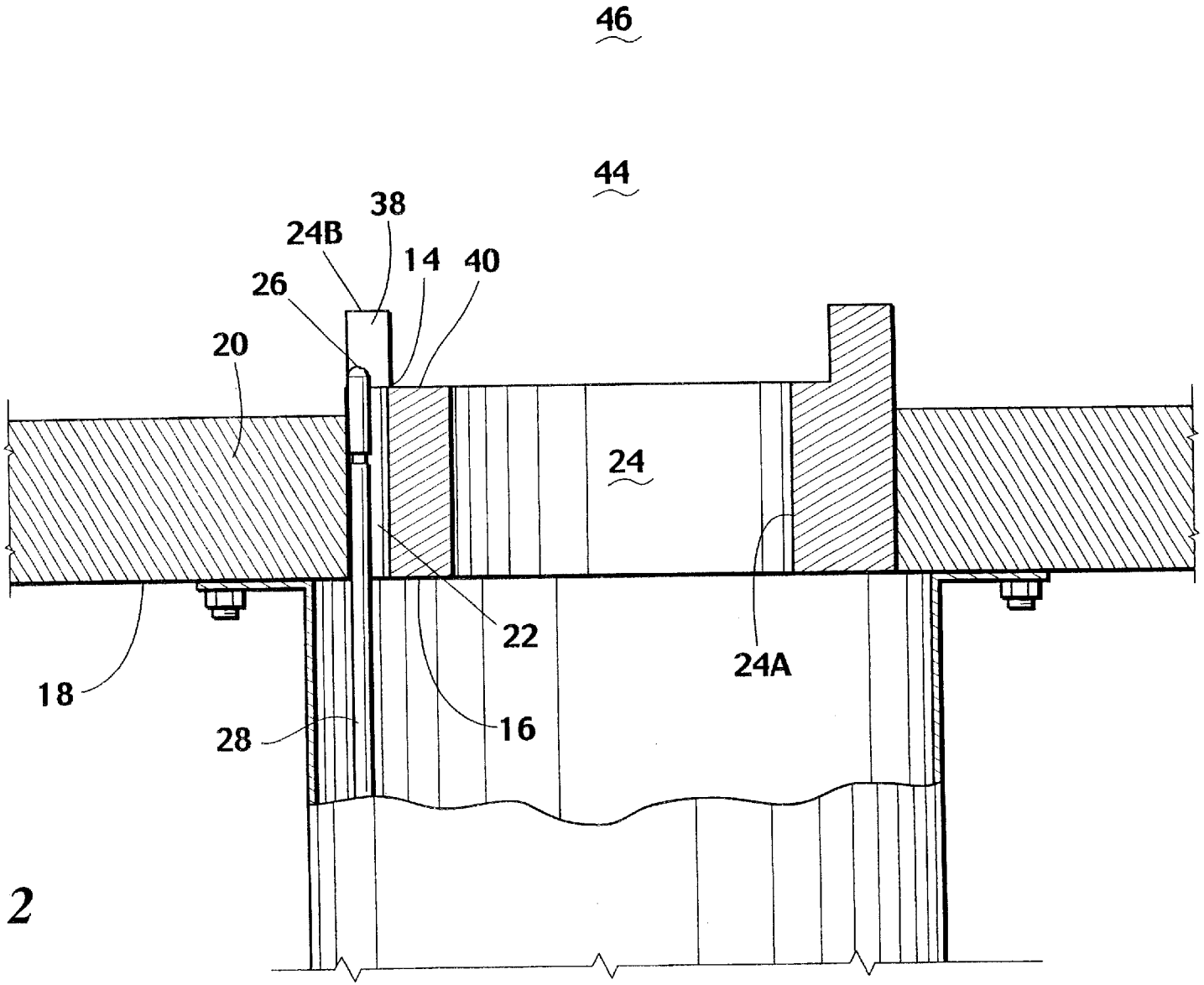
FIG. 2 is a partial, cut-away front elevation view of the block assembly of the present invention.
Figure 3:
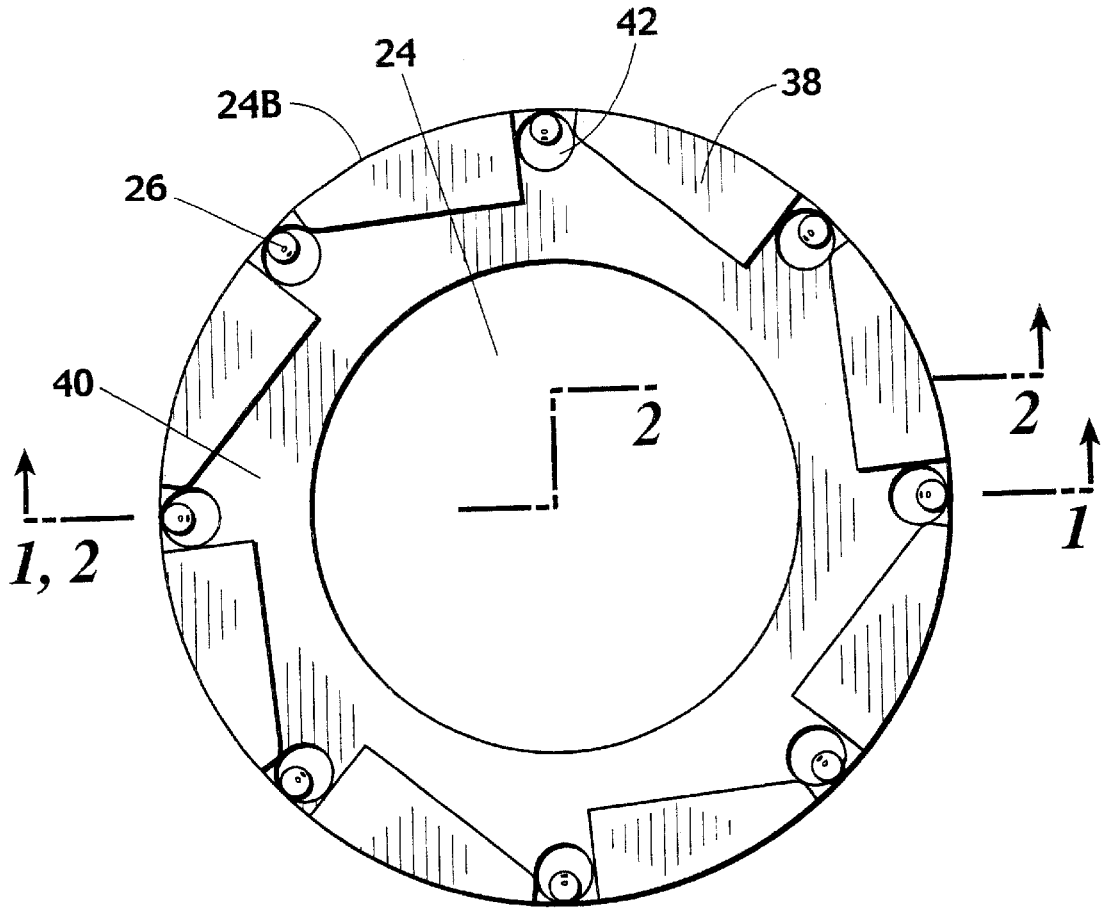
FIG. 3 is a top, section view of the burner apparatus of the present invention.
Figure 4:
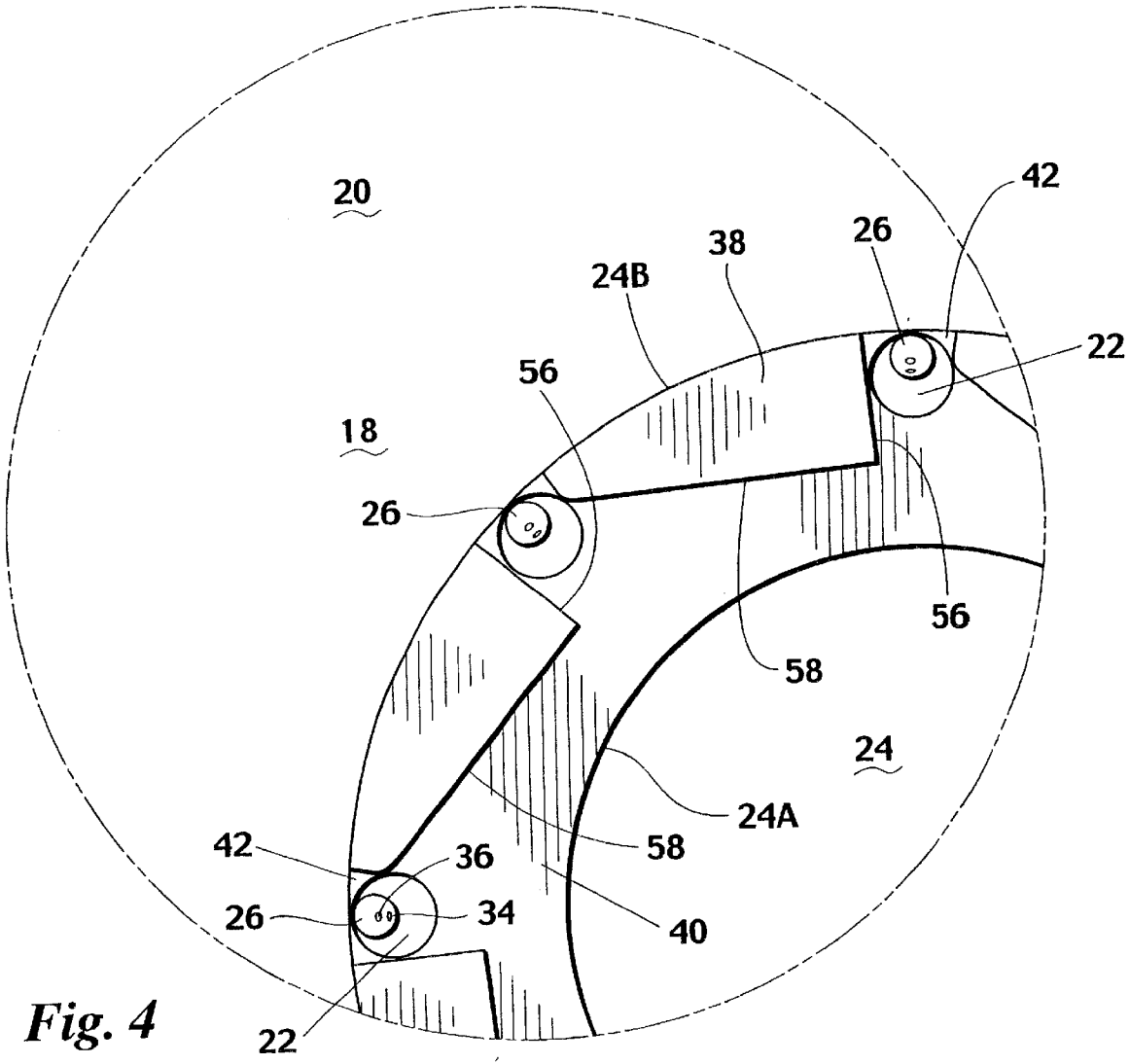
FIG. 4 is a close-up view of FIG. 3.

As shown in FIGS. 2 through 4, second cylindrical portion 24B is made up of a plurality of protrusions 38 which are positioned circumferentially to the central opening 24 and form a ledge 40. Protrusions 38 are spaced in such a manner to create a plurality of channels 42. Within each channel 42 is positioned a fuel gas jet tip 26.

As shown in the figures, ignition port 34 directs fuel gas in line with ledge 40 into an ignition zone 44 located just above central opening 24. Firing port 36 directs fuel gas in a substantially vertical direction. The fuel gas is directed vertically by firing port 36 and burns in the combustion zone 46 with the mixture of air and combustion products from the ignition zone 44. This mixture of air and combustion products from the ignition zone 44 is entrained by fuel gas from firing port 36 which is located at the cooler fringes of ignition zone 44. Because combustion of the entrained mixture in the combustion zone 46 occurs at a lower temperature, then the resulting production of $NO_X$ gas is inhibited.

As illustrated in FIGS. 1–4, each of flow channels 42 is an open flow channel bounded on only three sides. Each flow channel 42 is bounded on one side by the radial ledge 40 surrounding the central opening 24 extending through burner blocked. Each flow channel 42 is also bounded on a second side by a first surface 56 substantially perpendicular to radial ledge 40 and on a third side by a second surface 58 which is also preferably substantially perpendicular to radial ledge 40. Channel surfaces 56 and 58 are formed by protrusions 38.

The sides of channels 42 at the outlet end 14 of burner block 10 are open (unbounded). As also shown in FIGS. 1–4, channel surfaces 56 and 58 diverge with respect to each other away from the jet tip 26. Surface 56 extends toward central opening 24 and surface 58 is angled away from surface 56.

In the operation of the burner of this invention, air is drawn through central opening 24 so that air passes from the exterior of the enclosure to the interior, and as it passes into the interior it is thoroughly mixed with fuel gas by the burner so that substantially complete combustion occurs within the enclosure. To control air into and through central opening 24, air inlet 48 is in communication with housing 12. Air inlet 48 has an air inlet opening 50 to permit passage of air through the interior of housing 12 and vents into central opening 24.

Positioned below housing 12 is a gas supply conduit 52 which is in communication with gas conduit 28. The gas supply pipe 52 extends to a gas source.

The means of directing air through the burner is not specifically illustrated since such is standard procedure in the industry.

While the foregoing detailed description has described several embodiments of the present invention, it is to be understood that the above description is illustrative only and not limiting of the disclosed invention.

The claims and the specification describe the invention presented and the terms that are employed in the claims draw their meaning from the use of such terms in the specification. The same terms employed in the prior art may be broader in meaning than specifically employed herein. Whenever there is a question between the broader definition of such terms used in the prior art and the more specific use of the terms herein, the more specific meaning is meant.

While the invention has been described with a certain degree of particularity, it is manifest that many changes may be made in the details of construction and the arrangement of components without departing from the spirit and scope of this disclosure. It is understood that the invention is not limited to the embodiments set forth herein for purposes of exemplification, but is to be limited only by the scope of the attached claim or claims, including the fall range of equivalency to which each element thereof is entitled.

What is claimed:

1. A low $NO_X$ burner for combusting fuel gas and air in an enclosure comprising:

a burner block having an inlet end and an outlet end and a central opening therethrough between the ends, said block having a plurality of spaced apart passageways extending between said inlet and outlet ends, said passageways being at least generally parallel to and spaced from said central opening, said central opening in said block being defined by a first substantially cylindrical portion having a first end and a second end and a second portion having a third end and a fourth end, said first end of said first substantially cylindrical portion communicating with said block inlet end and said second end communicating with said third end of said second portion forming a ledge, said fourth end of said second portion communicating with said block outlet end; and a fuel ejection tip having an ignition port and at least one firing port, positioned within each passageway for injecting a first portion of fuel gas into said central opening and a second portion of said fuel gas above said central opening in a substantially vertical direction.

2. The low $No_X$ burner according to claim 1 wherein said second portion is defined by a plurality of protrusions being positioned around the circumference of said central opening forming channels between each protrusion.

3. The low $NO_X$ burner according to claim 2 wherein one of said plurality of passageways is positioned within each of said channels.

4. The low $NO_X$ burner according to claim 3 wherein said ignition port of each fuel gas jet tip of each fuel gas jet injects fuel gas into said central opening along said ledge and each of said firing port of each fuel gas jet tip of each fuel gas jet injects fuel gas into said central opening in a generally upward direction from said ledge.

5. The low $NO_X$ burner according to claim 1 being further defined as having an air damper to control the flow of air into said central opening.

6. The low $No_X$ burner according to claim 1 being further defined as having a gas manifold positioned in close proximity to and spaced apart from said burner inlet end and wherein each of said jet members has communication with said gas manifold.

7. A low $NO_X$ burner for combusting fuel gas and air in an enclosure comprising:

a burner block having an inlet end and an outlet end and a central opening therethrough between the ends, the burner block outlet end having a ledge; and a plurality of fuel ejection tips positioned in substantially the same plane as said ledge, each fuel ejection tip having an ignition port for injecting fuel gas into said central opening along said ledge, and at least one firing port for injecting fuel gas in a substantially vertical directions wherein said central opening in said block is defined by a first substantially cylindrical portion having a first end and a second end and a second portion having a third end and a fourth end, said first end of said first substantially cylindrical portion communicating with said block inlet end and said second end communicating with said third end of said second portion forming a ledge, said fourth end of said second portion communicating with said block outlet end.

8. The low $NO_X$ burner according to claim 7 wherein said second portion is defined by a plurality of protrusions being positioned around said central opening forming channels between each protrusion.

9. The low $NO_X$ burner according to claim 8 wherein within the passageways contained within said block, each of which having a fuel gas jet positioned therein, are positioned within each said channel formed between said protrusions.

10. A burner for reduced $NO_X$ emissions comprising:

a burner block having an inlet end, an outlet end, and an opening extending therethrough between said ends;

said burner block comprising a first longitudinal interior portion having a first end at said inlet end and a second end forming a radial ledge around said opening, said radial ledge being positioned in said opening between said inlet end and said outlet end; and a plurality of fuel ejectors positioned around said opening and having fuel ejection ports positioned therein in a manner effective for ejecting fuel inwardly along said radial ledge into said opening.

11. The burner of claim 10 wherein said fuel ejectors have second fuel ejection ports positioned therein in a manner effective for ejecting fuel from said second fuel ejection ports toward a combustion zone outside of said outlet end.

12. The burner of claim 10 further comprising a plurality of lateral flow channels on said ledge, wherein said fuel ejectors and said ports are positioned for ejecting said fuel through said flow channels and said flow channels are open at said outlet end of said burner block.

13. The burner of claim 12 wherein each of said flow channels is bounded on one side by said radial ledge, is bounded on a second side by a first surface substantially perpendicular to said radial ledge, and is bounded on a third side by a second surface substantially perpendicular to said radial ledge.

14. The burner of claim 13 wherein said first and said second surfaces diverge, with respect to each other, away from said fuel ejectors.

15. A burner for reduced $NO_X$ emissions comprising:

a burner block having an inlet end, an outlet end, and an opening extending therethrough between said ends;

a plurality of flow channels within said burner block around said opening, said flow channels being bounded on one side by a ledge in said burner block around said opening and said flow channels being unbounded at said outlet end of said burner block; and a plurality of fuel ejectors positioned around said opening having ejection ports positioned therein in a manner effective for ejecting fuel inwardly through said flow channels along said ledge into said opening.

16. The burner of claim 15 wherein each of said flow channels diverges along said ledge away from said fuel ejectors.

17. The burner of claim 15 wherein said fuel ejectors have second fuel ejection ports positioned therein in a manner effective for ejecting fuel from said second fuel ejection ports toward a combustion zone outside of said outlet end.

18. The burner of claim 17 wherein said first surface extends toward said opening and said second surface is angled away from said first surface.

19. The burner of claim 15 wherein each of said flow channels is bounded on a second side by a first surface substantially perpendicular to said ledge and is bounded on a third side by a second surface substantially perpendicular to said ledge.

20. A burner for reduced $NO_X$ emissions comprising:

a burner block having an inlet end, an outlet end, and an opening extending therethrough between said ends;

a plurality of open flow channels within said burner block, said open flow channels being unbounded at said outlet end of said burner block; and a plurality of fuel ejectors positioned around said opening having ejected ports positioned in a manner effective for ejecting fuel through said open flow channels into said opening, wherein each of said open flow channels has sides which diverge, with respect to each other, away from said fuel ejectors.

21. A burner for reduced $NO_X$ emissions comprising:

a burner block having an inlet end, an outlet end, and an opening extending therethrough between said ends;

a plurality of open flow channels within said burner block, said open flow channels being unbounded at said outlet end of said burner block; and a plurality of fuel ejectors positioned around said opening having ejection ports positioned in a manner effective for ejecting fuel through said open flow channels into said opening, wherein said fuel ejectors have second fuel ejection ports positioned therein in a manner effective for ejecting fuel from said second fuel ejection ports toward a combustion zone outside of said outlet end.

* * * * *

UNITED STATES PATENT AND TRADEMARK OFFICE

CERTIFICATE OF CORRECTION

PATENT NO. : 6,394,792 B1
DATED : May 28, 2002
INVENTOR(S) : Kirk et al.

It is certified that error appears in the above-identified patent and that said Letters Patent is hereby corrected as shown below:

Column 5,
Line 67, "directions" should read -- direction, --

Signed and Sealed this

Ninth Day of July, 2002

*Attest:*

*Attesting Officer*

JAMES E. ROGAN
*Director of the United States Patent and Trademark Office*